US009596942B2

(12) United States Patent
Kubota et al.

(10) Patent No.: US 9,596,942 B2
(45) Date of Patent: Mar. 21, 2017

(54) CUSHION

(71) Applicant: HONDA ACCESS CORP., Niiza-shi, Saitama (JP)

(72) Inventors: Yutaka Kubota, Niiza (JP); Kazumichi Hamaguchi, Niiza (JP); Hideyuki Suzuki, Niiza (JP); Ryo Abe, Niiza (JP)

(73) Assignee: HONDA ACCESS CORP., Niiza-shi (JP)

( * ) Notice: Subject to any disclaimer, the term of this patent is extended or adjusted under 35 U.S.C. 154(b) by 0 days.

(21) Appl. No.: 14/700,942

(22) Filed: Apr. 30, 2015

(65) Prior Publication Data

US 2016/0174721 A1 Jun. 23, 2016

(30) Foreign Application Priority Data

Dec. 19, 2014 (JP) ..... 2014-257532

(51) Int. Cl.
*A47C 20/02* (2006.01)
*A47C 16/00* (2006.01)
(Continued)

(52) U.S. Cl.
CPC ..... *A47C 16/00* (2013.01); *A47C 7/383* (2013.01); *A47C 20/021* (2013.01); *A47C 20/023* (2013.01); *A47G 9/10* (2013.01)

(58) Field of Classification Search
CPC ..... A47C 16/00; A47C 27/00; A47G 9/10
See application file for complete search history.

(56) References Cited

U.S. PATENT DOCUMENTS 3,775,785 A * 12/1973 Mittendorf ..... A47C 27/00 5/640
3,902,759 A * 9/1975 Monteforte ..... A47C 17/045 297/452.16
(Continued)

FOREIGN PATENT DOCUMENTS

JP 42-593 Y1 1/1967
JP S53-151615 U 4/1978
(Continued)

OTHER PUBLICATIONS

Office Action dated Dec. 15, 2015, issued in counterpart Japanese Application No. 2014-257532, with English Translation (9 pages).

*Primary Examiner* — David E Sosnowski
(74) *Attorney, Agent, or Firm* — Westerman, Hattori, Daniels & Adrian, LLP

(57) ABSTRACT

A cushion includes a first cushion portion, a second cushion portion, and a connecting portion interconnecting the first cushion portion and the second cushion portion such that the first cushion portion and the second cushion portion are brought to an open position to unfold the cushion. The first cushion portion and the second cushion are movable to a closed position to fold the cushion along the connecting portion into a generally rectangular parallelepiped. The connecting portion is provided along one corner of the generally rectangular parallelepiped and interconnects one end of a first surface of the first cushion portion and one end of a first surface of the second cushion portion. An inclining surface of the first cushion portion and an inclining surface of the second cushion portion are both planar surfaces.

4 Claims, 10 Drawing Sheets

(51) Int. Cl.

| | |
|---|---|
| ***A47C 20/00*** | (2006.01) |
| ***A47C 7/38*** | (2006.01) |
| *A47G 9/10* | (2006.01) |

(56) References Cited

U.S. PATENT DOCUMENTS

| | | | | | |
|---|---|---|---|---|---|
| 5,216,772 | A * | 6/1993 | Clute | A47D 13/08 | 5/630 |
| 5,265,292 | A * | 11/1993 | Underell | A47C 4/52 | 297/380 |
| 5,272,780 | A * | 12/1993 | Clute | A47D 13/08 | 5/632 |
| 5,632,050 | A * | 5/1997 | Zajas | A47C 20/026 | 5/632 |
| 6,170,908 | B1 * | 1/2001 | Jewell | A47C 13/00 | 297/118 |
| D446,676 | S * | 8/2001 | Mayes | A47C 13/00 | D6/601 |
| 6,735,798 | B1 * | 5/2004 | Sekizawa | A47C 17/045 | 5/630 |
| 6,839,928 | B1 * | 1/2005 | Woodall | A47C 4/52 | 5/653 |
| 7,007,328 | B1 * | 3/2006 | Bailey | A47C 16/005 | 5/632 |
| 7,020,918 | B1 * | 4/2006 | Tinsley | A47C 16/00 | 5/630 |
| 7,305,728 | B2 * | 12/2007 | Schlieps | A47C 9/027 | 5/655.9 |
| 8,578,526 | B1 * | 11/2013 | Rosso | A47C 1/146 | 5/417 |
| 8,607,382 | B1 * | 12/2013 | Cohron, III | A47G 9/0253 | 297/397 |
| 8,671,480 | B1 * | 3/2014 | Leach | A47C 20/025 | 5/630 |
| 2005/0189809 | A1 * | 9/2005 | Lombert | A47C 16/04 | 297/452.26 |
| 2007/0205640 | A1 * | 9/2007 | Pecorino | A47C 7/62 | 297/188.06 |
| 2011/0145994 | A1 * | 6/2011 | Pileggi | A47G 9/1081 | 5/655.3 |

FOREIGN PATENT DOCUMENTS

| | | | |
|---|---|---|---|
| JP | S54-151615 | U | 4/1978 |
| JP | 6-26615 | U | 4/1994 |
| JP | 6-52622 | U | 7/1994 |
| JP | 2008-029390 | A | 2/2008 |
| JP | 3150454 | U | 5/2009 |

* cited by examiner

CUSHION

FIELD OF THE INVENTION

The present invention relates to a cushion including a first cushion portion, a second cushion portion, and a connecting portion interconnecting the first and second cushion portions such that the first and second cushion portions can be brought to an open position to unfold the cushion.

BACKGROUND OF THE INVENTION

A well-known cushion includes a plurality of cushion portions which can be opened to unfold the cushion for use of the unfolded cushion. Such a cushion is known from JP-U-3150454.

The cushion as taught in JP-U-3150454 includes three cushion portions connected to one another so as to be opened to unfold the cushion, and an additional detachable cushion portion different from these cushion portions. A user can unfold the cushion into different shapes, attaching or detaching the additional cushion portion for his intended use.

It is desirable for the opened cushion portions to be handled such that the cushion can be easily changed into different unfolded modes.

SUMMARY OF THE INVENTION

An object of the present invention is to provide a cushion including cushion portions configured such that the cushion can be easily changed into different unfolded modes.

According to one aspect of the present invention, there is provided a cushion including a first cushion portion, a second cushion portion, and a connecting portion interconnecting the first cushion portion and the second cushion portion such that the first cushion portion and the second cushion portion are brought to an open position to unfold the cushion, the first cushion portion and the second cushion being movable to a closed position to fold the cushion along the connecting portion into a generally rectangular parallelepiped, wherein the first cushion portion comprises a first surface defining one side of the generally rectangular parallelepiped, an inclining surface extending obliquely from one end of the first surface, and a second surface extending at a generally right angle from an opposite end of the first surface, wherein the second cushion portion comprises a first surface defining another side of the generally rectangular parallelepiped different from the one side, an inclining surface extending obliquely from one end of the first surface of the second cushion portion, and a second surface extending at a generally right angle from an opposite end of the first surface of the second cushion portion, wherein the connecting portion is provided along one corner of the generally rectangular parallelepiped and interconnects the one end of the first surface of the first cushion portion and the one end of the first surface of the second cushion portion, wherein the inclining surface of the first cushion portion and the inclining surface of the second cushion portion are both planar surfaces, and wherein the cushion has three modes, the three modes being a folded mode, a first unfolded mode, and a second unfolded mode, the folded mode being a mode in which the cushion is folded into the generally rectangular parallelepiped with the inclining surface of the first cushion portion and the inclining surface of the second cushion portion contacting each other, the first unfolded mode being a mode in which the first surface of the first cushion portion and the first surface of the second cushion portion are both in contact with the ground, and the inclining surface of the first cushion portion and the inclining surface of the second cushion portion are opposed to each other, and the second unfolded mode being a mode in which the inclining surface of the first cushion portion and the inclining surface of the second cushion portion are both in contact with the ground, and the first surface of the first cushion portion and the first surface of the second cushion portion are opposed to each other.

The connecting portion is provided along the corner of the rectangular parallelepiped, and the inclining surfaces of the first and second cushion portions are the planar surfaces such that the inclining surfaces of the first and second cushion portions can contact each other. The cushion has three forms, i.e., the folded mode in which the cushion is folded into the generally rectangular parallelepiped with the inclining surfaces of the first and second cushion portions contacting each other, the first unfolded mode in which the first surfaces of the first and second cushion portions are both in contact with the ground and the inclining surfaces of the first and second cushion portions are opposed to each other, and the second unfolded mode in which the inclining surfaces of the first and second cushion portions are both in contact with the ground and the first surfaces of the first and second cushion portions are opposed to each other. For a change from the first unfolded mode to the second unfolded mode, the first and second surfaces of the first and second cushion portions are brought out of contact with the ground into an upward-facing position and the inclining surfaces of the first and second cushion portions are brought from an upward-facing position into contact with the ground. That is, the change in the unfolded mode can be made by turning the cushion upside down. A change from the second unfolded mode to the first unfolded mode can be made in the same manner. Thus, the unfolded cushion can be easily changed to the different unfolded mode.

Additionally, a change from the first or second unfolded mode to the folded mode can be made by bringing the inclining surfaces of the first and second cushion portions into contact with each other. The cushion can be folded just by swinging the first and second cushion portions on the connecting portion toward each other. Thus, the change from the unfolded state to the folded state can be made easily.

Preferably, in the first unfolded mode, the second surface of the first cushion portion has a height different from a height of the second surface of the second cushion portion.

In the first unfolded mode, the height of the second surface of the first cushion portion is different from the height of the second surface of the second cushion portion. For example, in placing the user's feet on the cushion, the cushion is turned into a back to front position to change the surface for the user's feet Fo to rest on. These surfaces are different in height from each other. Of these surfaces of different characteristics, the user can use his favorite one. The use of the favorite surface requires only rotating the cushion horizontally. That is, the cushion has a high operability.

Preferably, in the folded mode, the first cushion portion and the second cushion portion are locked to each other by a hook-and-loop fastener.

In the folded mode, the first cushion portion and the second cushion portion are locked to each other by the hook-and-loop fastener. Thus, the folded mode is reliably maintained to prevent the first and second cushion portions from being unintentionally opened as the cushion is hand-carried.

Preferably, the first cushion portion and the second cushion portion both comprise cushion bodies covered by a cover, and the cover has a pocket formed therein.

The cover covering the cushion bodies has the pocket provided therein to increase convenience of the cushion.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

A first preferred embodiment of the present invention is discussed below.

Figure 1:
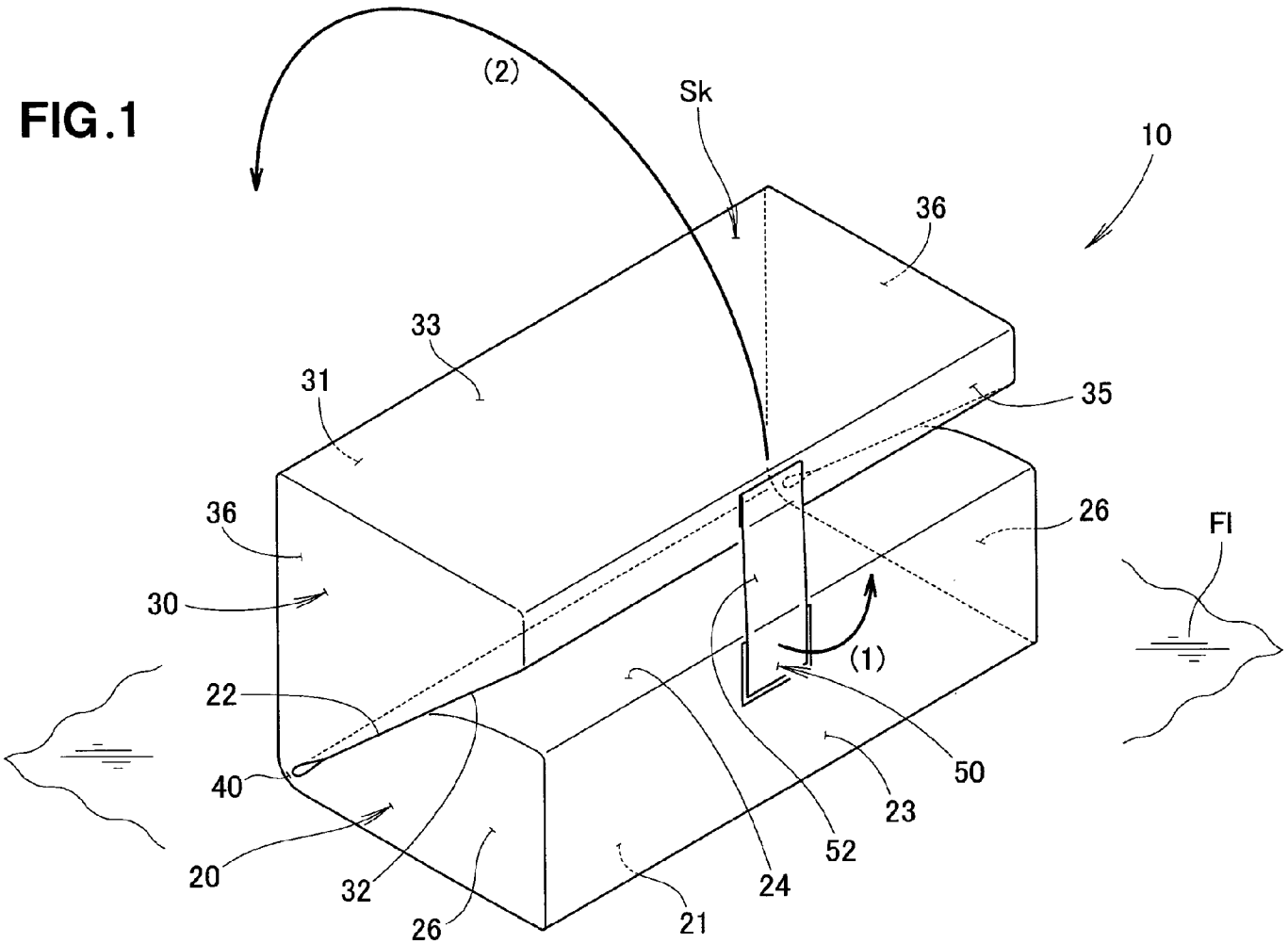
FIG. 1 is a perspective view of a cushion in a first embodiment of the present invention.

Reference is made to FIG. 1. A cushion 10 is shown in a folded position in which the cushion 10 is easy to hand-carry. The folded cushion 10 has a generally rectangular parallelepiped shape. The generally rectangular parallelepiped folded position of the cushion 10 is hereinafter referred to "folded mode" where appropriate.

Figure 2:
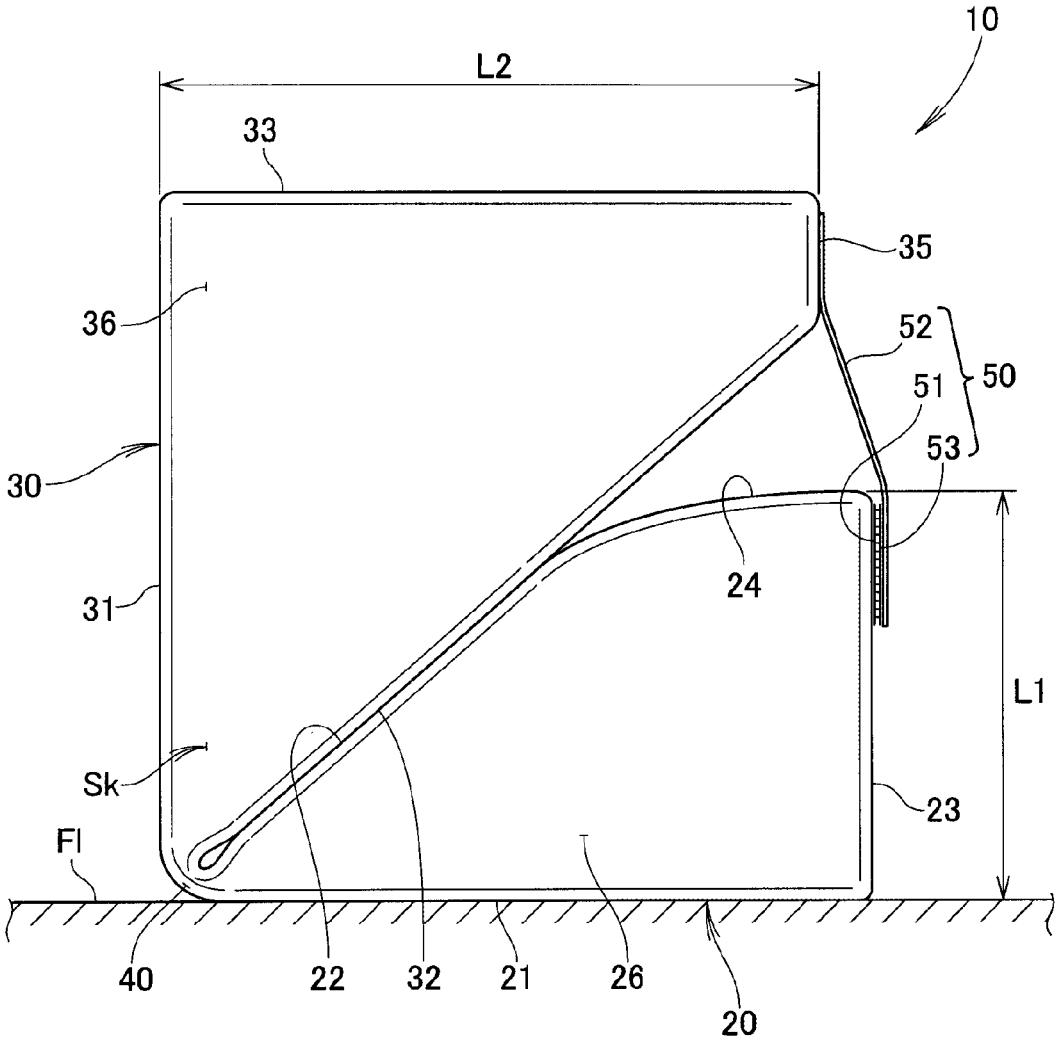
FIG. 2 is a side elevation view of the cushion shown in FIG. 1.

Reference is made to FIG. 2. The cushion 10 includes a first cushion portion 20 contacting a floor surface Fl, and a second cushion portion 30 overlapping the first cushion portion 20. The cushion 10 further includes a connecting portion 40 interconnecting the first cushion portion 20 and the second cushion portion 30 such that the portions 20, 30 can be brought to an open position to unfold the cushion 10, and a locking portion 50 locking the first cushion portion 20 and the second cushion portion 30 together.

Figure 3:
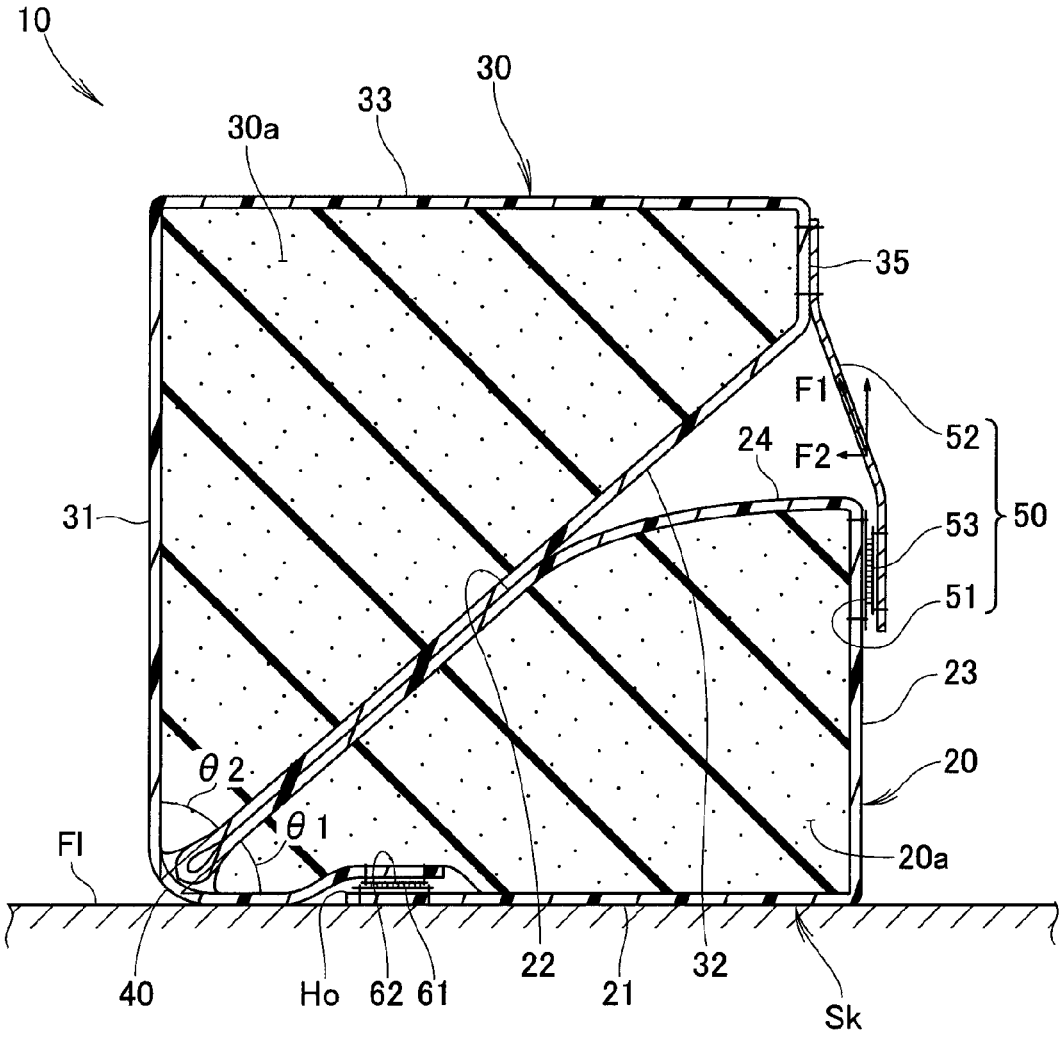
FIG. 3 is a cross sectional view of the cushion shown in FIG. 2.

Reference is made to FIG. 3. The first cushion portion 20 is made up of a first cushion body 20*a* covered by a cover Sk. The second cushion portion 30 is made in the same manner as the first cushion portion 20. That is, the second cushion portion 30 is made up of a second cushion body 30*a* covered by the cover Sk. The first and second cushion bodies 20*a*, 30*a* distinct from each other are covered by the common cover Sk.

The material of the first and second cushion bodies 20*a*, 30*a* can be urethane. The material of the cover Sk can be artificial leather.

Reference is made back to FIGS. 1 and 2. The first cushion portion 20 has a first surface 21 defining one side (bottom side) of the rectangular parallelepiped of the cushion 10 in the folded mode, and an inclining surface 22 extending obliquely from an end portion (one end) of the first surface 21 on a side of the connecting portion 40. The first cushion portion 20 also has a second surface 23 extending generally perpendicularly from an opposite end portion (the other end) of the first surface 21 opposite from the connecting portion 40, and a curved surface 24 extending from an end portion of the inclining surface 22 opposite from the connecting portion 40, to an upper end of the second surface 23. The first cushion portion 20 further has lateral side surfaces 26 (only one shown in FIG. 2) each surrounded by respective lateral edges of the first surface 21, inclining surface 22, second surface 23 and curved surface 24.

The second cushion portion 30 has a first surface 31 rising from a vicinity of the connecting portion 40 and defining one side (bottom side) of the rectangular parallelepiped, and an inclining surface 32 extending obliquely from an end portion (one end) of the first surface 31 on a side of the connecting portion 40. The second cushion portion 30 also has a second surface 33 extending generally perpendicularly from an opposite end portion (the other end) of the first surface 31 opposite from the connecting portion 40, and a third surface 35 extending from an end portion of the inclining surface 32 opposite from the connecting portion 40, to an upper end of the second surface 33. The second cushion portion 30 further has lateral side surfaces 36 (only one shown in FIG. 2) each surrounded by respective lateral edges of the first surface 31, inclining surface 32, second surface 33 and third surface 35.

Reference is made to FIGS. 2 and 3. The connecting portion 40 is made up of the cover Sk. The connecting portion 40 interconnects the one end of the first surface 21 of the first cushion portion and the one end of the first surface 31 of the second cushion portion.

The locking portion 50 is comprised of a first hook-and-loop fastener section 51 sewn to the second surface 23 of the first cushion portion, a belt-shaped strap member 52 sewn to the third surface 35 of the second cushion, and a second hook-and-loop fastener section 53 sewn to the strap member 52.

In the folded mode, the second hook-and-loop fastener section 53 is locked to the first hook-and-loop fastener section 51. To unfold the cushion, the hook-and-loop fastener sections 51, 53 are unlocked to bring the first and second cushion portions 20, 30 to the open position.

The cover Sk integrally covers the first and second cushion portions 20, 30 and connects the first and second cushion portions 20, 30 together. The cover Sk has the connecting portion 40 formed at a portion thereof which is not filled with urethane. The first and second cushion portions 20, 30 can be connected to each other so as to fold the cushion along the connecting portion 40 and unfold the cushion.

The cover Sk has a filling hole Ho for filling the first and second cushion bodies 20*a*, 30*a*. This filling hole Ho is closed by hook-and-loop fastener sections 61, 62. The hook-and-loop fastener sections 61, 62 are sewn to the cover Sk along the filling hole Ho. The filling hole Ho has edges each folded back on itself and sewn thereto to prevent fraying of the cover Sk.

The first surface 21 of the first cushion portion is made up of a generally rectangular planar surface. The first surface 21 of the first cushion portion extends at a generally right angle to the first surface 31 of the second cushion portion, and extends in generally parallel to the second surface 33 of the second cushion portion.

The inclining surface 22 of the first cushion portion is made up of a generally rectangular planar surface. The inclining surface 22 of the first cushion portion has its entirety contacting the inclining surface 32 of the second cushion portion.

The second surface 23 of the first cushion portion is made up of a generally rectangular planar surface. The first hook-and-loop fastener section 51 is sewn to a substantial middle of the upper end of the second surface 23 of the first cushion portion.

The curved surface 24 of the first cushion portion is made up of a curved surface spaced from the inclining surface 32 of the second cushion portion. The curved surface 24 has an end portion on a side of the inclining surface 22 of the first cushion portion, and an end portion on a side of the second surface 23 of the first cushion portion. When the first surface 21 of the first cushion portion is in contact with the floor surface, the end portion of the curved surface 24 on the side of the second surface 23 of the first cushion portion is located higher than the end portion of the curved surface 24 on the side of the inclining surface 22.

Each of the first surface 31, the second surface 33 and the third surface 35 is made up of a generally rectangular planar surface. The first surface 31 of the second cushion portion extends at a generally right angle to the first surface 21 of the first cushion portion and the second surface 33 of the second cushion portion.

The inclining surface 32 of the second cushion portion is made up of a generally rectangular planar surface. The inclining surface 32 of the second cushion portion is in contact with the inclining surface 22 of the first cushion portion and is opposed to the curved surface 24 of the first cushion portion with a predetermined interval formed therebetween.

The second surface 33 of the second cushion portion has a length L2 larger than a length L1 of the second surface 23 of the cushion portion.

When the cushion is in the folded mode, the third surface 35 of the second cushion portion is located closer to a widthwise center of the cushion than the second surface 23 of the first cushion by a slight distance. The strap member 52 is sewn to a middle of the third surface 35 of the second cushion portion along the entire height of the third surface 35.

An angle θ1 defined between the first surface 21 of the first cushion portion and the inclining surface 22 of the first cushion portion is 45 degrees. An angle θ2 defined between the first surface 31 of the second cushion portion and the inclining surface 32 of the second cushion portion is 45 degrees. That is, the angle θ1 defined between the first surface 21 of the first cushion portion and the inclining surface 22 of the first cushion portion is equal to the angle θ2 defined between the first surface 31 of the second cushion portion and the inclining surface 32 of the second cushion portion.

Figure 4:
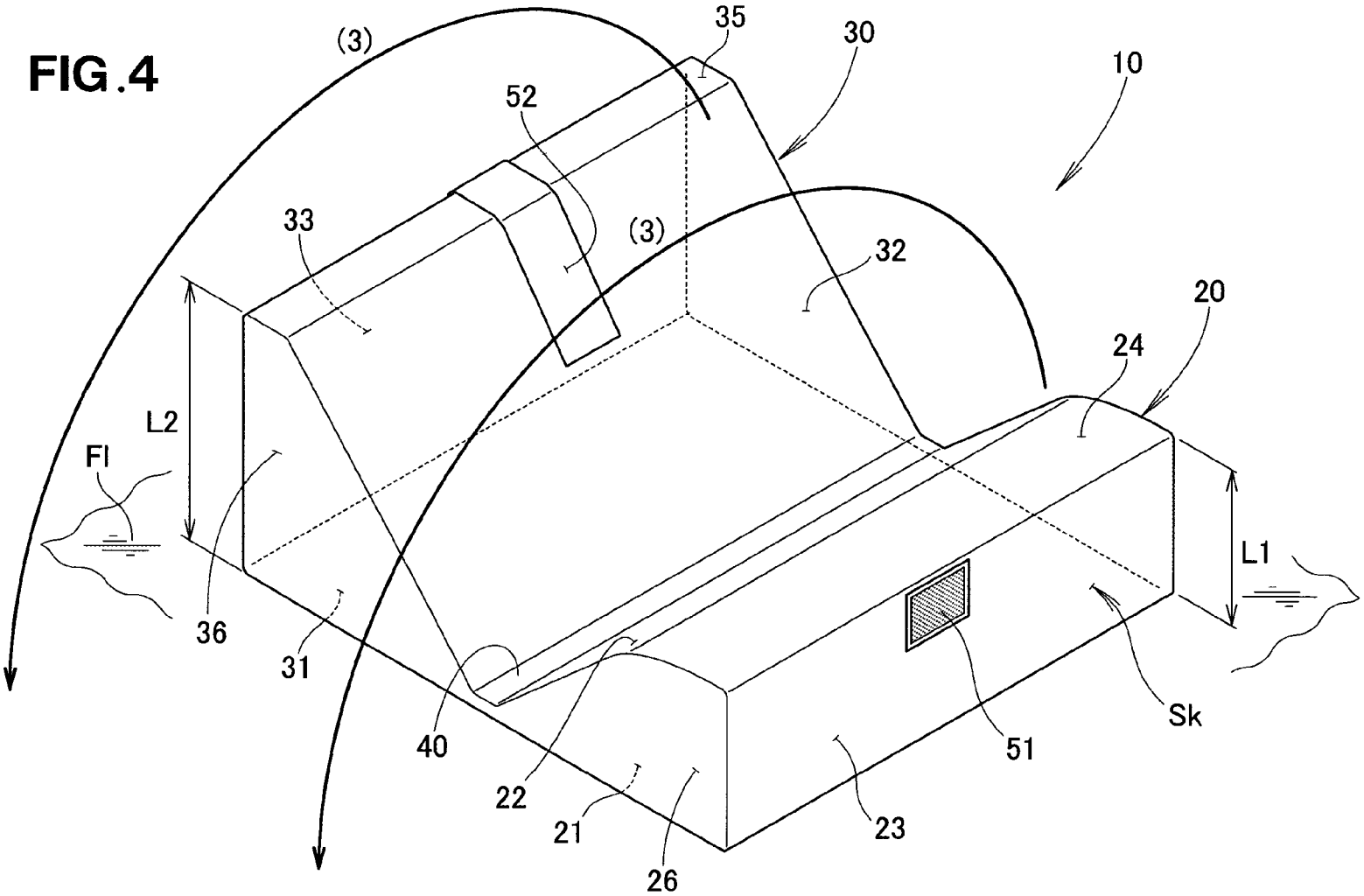
FIG. 4 is a view showing the cushion in a first unfolded mode.

Reference is made to FIGS. 2 and 4. The cushion 10 can be used with the first and second cushion portions 20, 30 in the open position. More specifically, the first and second cushion portions 20, 30 can be brought from a closed position in which the cushion is in the folded mode shown in FIG. 2, to the open position in which the cushion is in a first unfolded mode shown in FIG. 4.

To unfold the cushion into the first unfolded mode, first, the locking portion 50 is unlocked as shown by an arrow (1) of FIG. 1. Next, the second cushion portion 30 is swung as shown by an arrow (2). As a result, the first surface 21 of the first cushion portion and the first surface 31 of the second cushion portion are both in contact with the floor surface, such that the cushion is in the first unfolded mode in which the inclining surface 22 of the first cushion portion is opposed to the inclining surface 32 of the second cushion portion.

Figure 5:
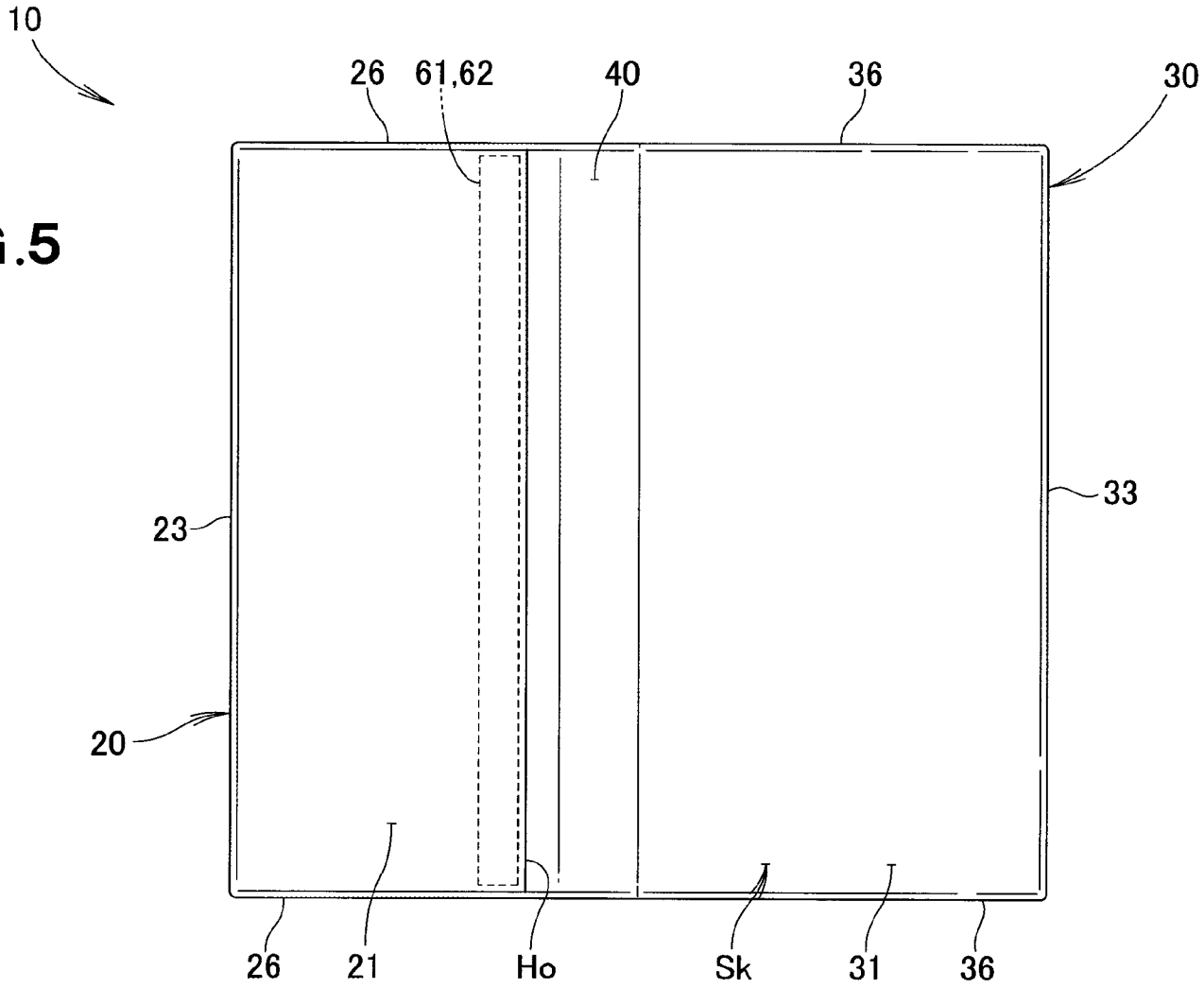
FIG. 5 is a bottom plan view of the cushion shown in FIG. 4.

Reference is made to FIG. 5. The cushion 10 in the first unfolded mode shown in FIG. 4 is shown as viewed from the bottom thereof. The filling hole Ho is formed in a portion of the first surface 21 of the first cushion portion. In other words, the filling hole Ho is formed in the portion avoiding the connecting portion 40. The filling hole Ho may be formed in the second cushion portion 30. The reason will be discussed later.

The cushion 10 can be used in a second unfolded mode different from the first unfolded mode. A method of changing the first unfolded mode to the second unfolded mode is discussed. As shown by an arrow (3) of FIG. 4, the cushion 10 is turned over to bring the inclining surface 22 of the first cushion and the inclining surface 32 of the second cushion portion into contact with the floor surface.

Figure 6:
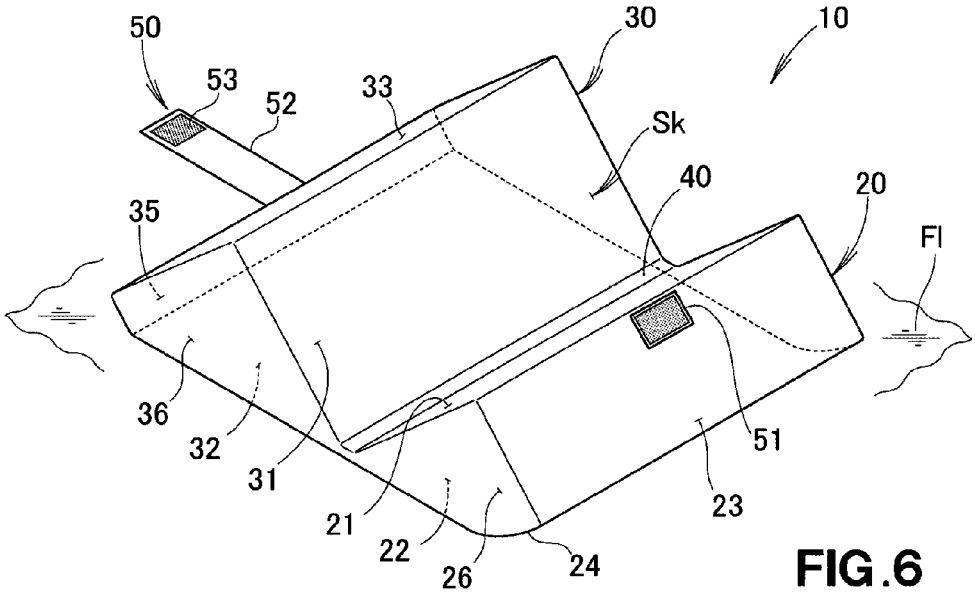
FIG. 6 is a view showing the cushion in a second unfolded mode.

Reference is made to FIG. 6. The turnover of the cushion 10 brings the inclining surface 22 of the first cushion portion and the inclining surface 32 of the second cushion portion into contact with the floor surface. That is, the turnover of the cushion 10 brings the cushion 10 into the second unfolded mode in which the inclining surface 22 of the first cushion portion and the inclining surface 32 of the second cushion portion are both in contact with the floor surface and the first surface 21 of the first cushion portion is opposed to the first surface 31 of the second cushion portion.

As discussed above, the cushion 10 can be used in the three modes, i.e., the folded mode (FIG. 2), the first unfolded mode (FIG. 4) and the second unfolded mode (FIG. 6). A discussion is made below as to examples of how to use the cushion in the respective modes.

Figure 7A:
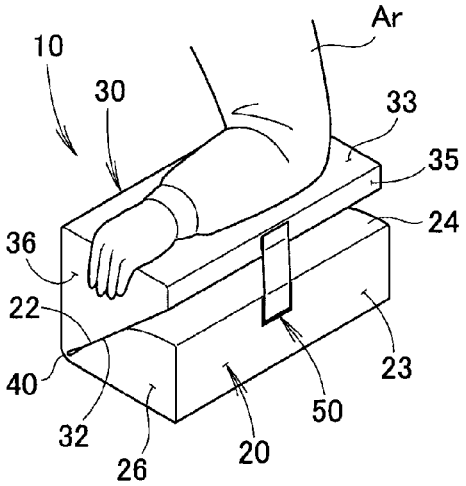
FIG. 7A and FIG. 7B show examples of use of the cushion in a folded mode.
Figure 7B:
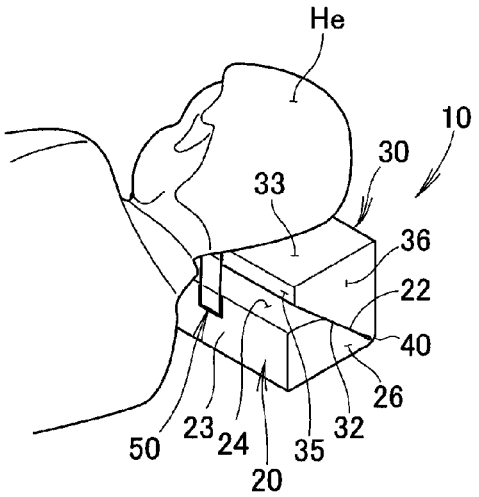

Reference is made to FIGS. 7A and FIG. 7B. In the folded mode, a user of the cushion 10 can place his arm Ar on the cushion 10, as shown in FIG. 7A, or place his head He on the cushion 10, as shown in FIG. 7B. That is, the cushion 10 in the folded mode can be used as an armrest or a pillow.

Reference is made also to FIG. 3. The first cushion portion 20 has the curved surface 24 opposed to and spaced from the inclining surface 32 of the second cushion portion. The first cushion portion 20 contacts the inclining surface 32 of the second cushion portion at the inclining surface 22 of the first cushion portion and is spaced from the inclining surface 32 of the second cushion portion at the curved surface 24 of the first cushion portion. In the region where the inclining surface 32 of the second cushion portion is spaced from the curved surface 24 of the first cushion portion, the second cushion portion 20 easily flexes under the weight of the arm Ar or the head He. The region where the inclining surface 22 of the first cushion portion and the inclining surface 32 of the second cushion portion are in contact with each other flexes a smaller amount under the weight than the region where the inclining surface 32 is not in contact with the first cushion portion 20. The user can place his arm Ar or head He on the region which is more comfortable to use.

Figure 8A:
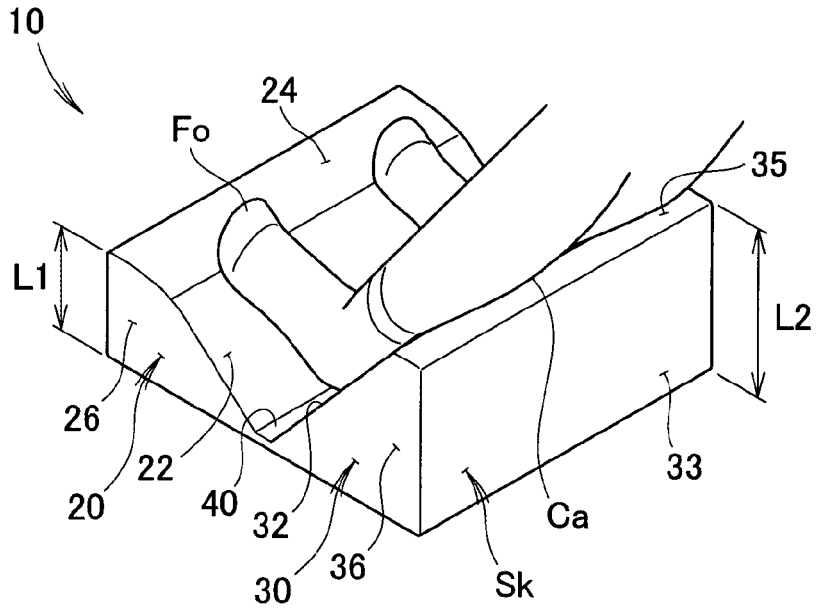
FIG. 8A and FIG. 8B show examples of use of the cushion in the first unfolded mode.
Figure 8B:
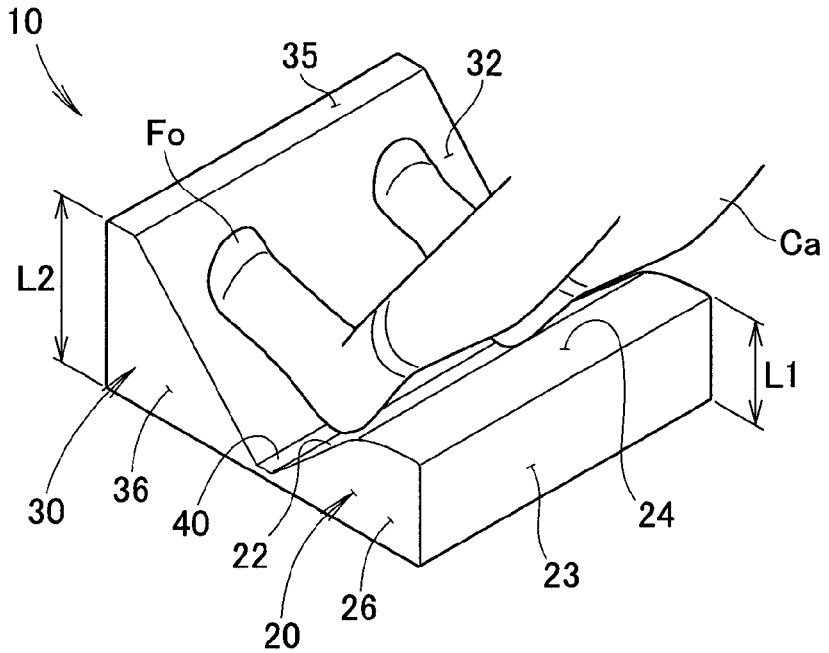

Reference is made to FIGS. 8A and 8B. As shown in FIGS. 8A and 8B, the user can place his feet Fo on the cushion 10 in the first unfolded mode. In FIG. 8A, the user uses the cushion 10 with the second cushion portion 30 disposed on his body side. The user's feet Fo rest on the inclining surface 22 of the first cushion portion. In FIG. 8B, the user uses the cushion 10 with the first cushion portion 20 disposed on his body side. The user's feet Fo rest on the inclining surface 32 of the second cushion portion.

In the first unfolded mode, the height L2 of the second surface 33 of the second cushion portion is larger than the height L1 of the second surface 23 of the first cushion portion. Thus, in the first unfolded mode, the user can use the cushion 10 in two different manners.

As shown in FIG. 8A, when the second cushion portion 30 having the larger height is disposed on the user's body side, his calf Ca can partially lean on the cushion 10. As shown in FIG. 8B, on the other hand, when the second cushion portion 30 having the larger height is disposed away from the user's body side, the entire feet Fo can rest on the cushion 10.

Figure 9A:
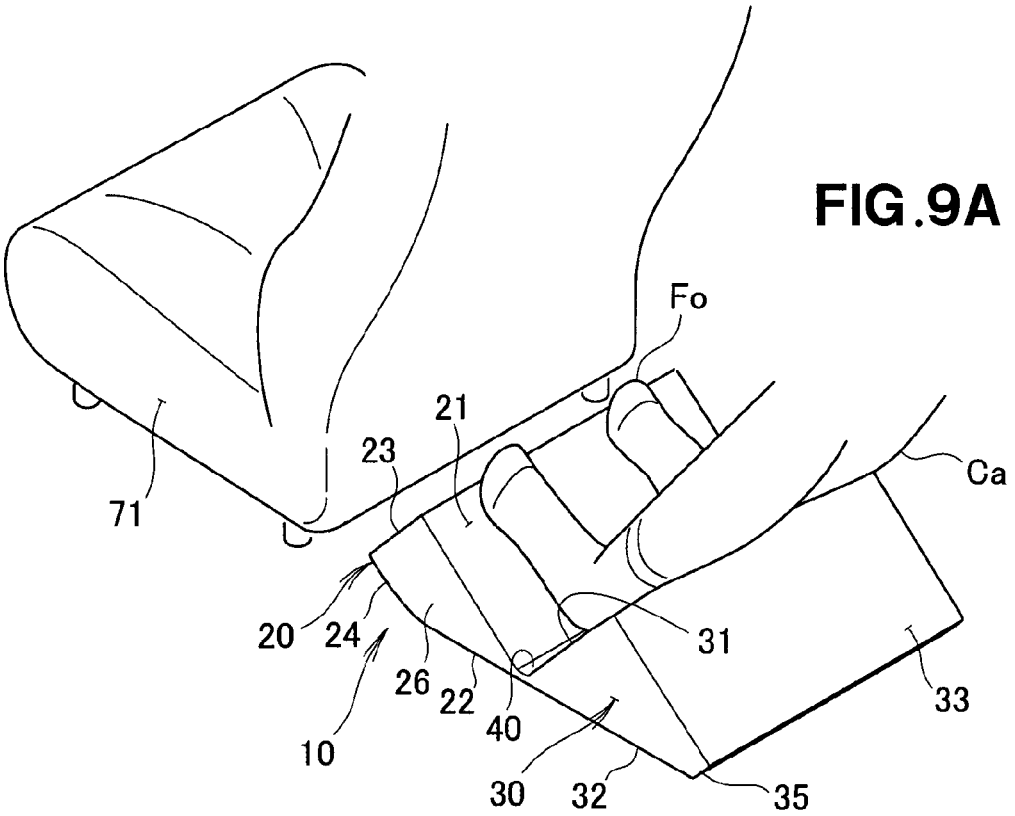
FIG. 9A and FIG. 9B show examples of use of the cushion in the second unfolded mode.
Figure 9B:
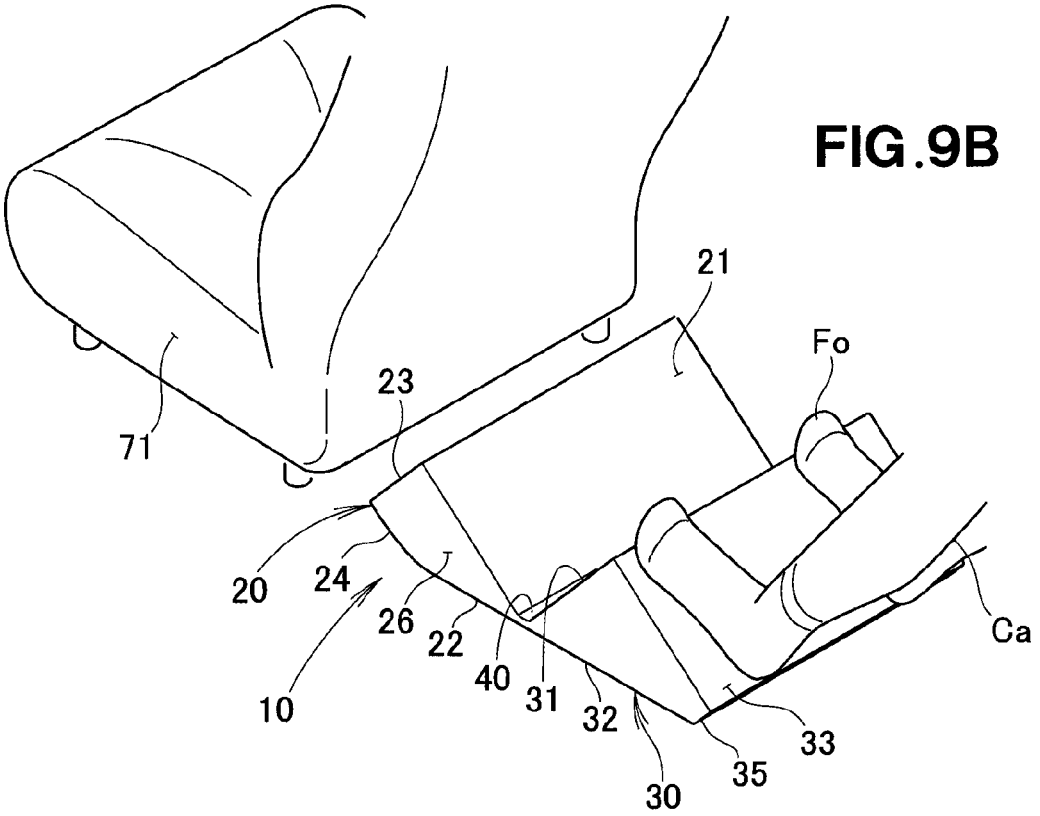

Reference is made to FIGS. 9A and 9B. As shown in FIGS. 9A and 9B, in the second unfolded mode, the user can place his feet Fo on the cushion 10. In the second unfolded mode, the first surface 31 of the first cushion portion and the second surface 33 of the second cushion portion are both opposed to the user.

For example, an occupant sitting on a seat in a second row in a vehicle may use the cushion 10. In this case, the cushion 10 is placed immediately after a seat 71 in a first row. Although a space between the seat 71 in the first row and the seat in the second row is so small that it is difficult to place the cushion 10 in any location in conformity with the occupant's build, the second unfolded mode in which the first surface 21 of the first cushion portion and the second surface 33 of the second cushion portion are both opposed to the occupant allows the occupant to place his feet Fo on the surface which is easy to use, in conformity with his body shape. That is, the second unfolded mode is suitable for use of the cushion 10 in a space small to place the cushion.

The cushion 10 discussed above provides the following advantages.

Reference is made to FIG. 1. The connecting portion 40 is provided along a corner of the rectangular parallelepiped, and the inclining surfaces 22, 32 of the first and second cushion portions are planar surfaces such that the surfaces 22, 32 can contact each other. The cushion 10 has three forms, i.e., the folded mode in which the cushion is folded into the generally rectangular parallelepiped with the inclining surfaces 22, 32 contacting each other, the first unfolded mode (FIG. 4) in which the first surfaces 21, 31 of the first and second cushion portions are both in contact with the floor surface and the inclining surfaces 22, 32 of the first and second cushion portions are opposed to each other, and the second unfolded mode (FIG. 6) in which the inclining surfaces 22, 32 of the first and second cushion portions are both in contact with the floor surface and the first surfaces 21, 31 of the first and second cushion portions are opposed to each other.

Reference is made to FIGS. 4 and 6. For a change from the first unfolded mode to the second unfolded mode, the first and second surfaces 21, 31 of the first and second cushion portions are brought out of contact with the floor surface into an upward-facing position and the inclining surfaces 22, 32 of the first and second cushion portions are brought from an upward-facing position into contact with the floor surface. That is, the change in the unfolded mode can be made by turning the cushion 10 upside down. A change from the second unfolded mode to the first unfolded mode can be made in the same manner. Thus, the unfolded cushion can be easily changed to the different unfolded mode.

Additionally, a change from the first or second unfolded mode to the folded mode can be made by bringing the inclining surfaces 22, 32 of the first and second cushion portions into contact with each other. The cushion can be folded just by swinging the first and second cushion portions 20, 30 on the connecting portion 40 toward each other. Thus, the change from the unfolded state to the folded state can be made easily.

Reference is made to FIG. 8. In the first unfolded mode, the height L1 of the second surface 23 of the first cushion portion is different from the height L2 of the second surface 33 of the second cushion portion (in the embodiment, the height L1 is smaller than the height L2). For example, in placing the user's feet on the cushion 10, the cushion 10 is turned into a back to front position to change the surface for the user's feet Fo to rest on (i.e., the surface for the use's feet to rest on is changed to the inclining surface 22 of the first cushion portion or the inclining surface 32 of the second cushion portion). These surfaces are different in size from each other. Of these surfaces of different characteristics, the user can use his favorite one. The use of the favorite surface requires only rotating the cushion horizontally. That is, the cushion has a high operability.

Reference is made also to FIG. 2. The angle defined between the first surface 21 of the first cushion portion and the inclining surface 22 of the first cushion portion is equal to the angle defined between the first surface 31 of the second cushion portion and the inclining surface 32 of the second cushion portion. In the first unfolded mode, the first surface 21 of the first cushion portion and the first surface 31 of the second cushion portion are in contact with the floor surface and the inclining surfaces 22, 32 of the first and second cushion portions are opposed to each other. The user of the cushion can place his feet on one of the inclining surface 22 of the first cushion portion and the inclining surface 32 of the second cushion portion. Since the angle between the inclining surface 22 of the first cushion portion and the floor surface Fl is equal to the angle between the inclining surface 32 of the second cushion portion and the floor surface Fl, the user can keep his feet at the most comfortable angle whichever inclining surface the feet rest on.

Reference is made to FIG. 3. In the folded mode, the first cushion portion 20 and the second cushion portion 30 are locked to each other by a hook-and-loop fastener made up of the hook-and-loop fastener sections 51, 53. Thus, the folded mode is reliably maintained to prevent the first and second cushion portions 20, 30 from being unintentionally opened as the cushion 10 is hand-carried.

The first and second cushion portions 20, 30 are made up of the different cushion bodies 20*a*, 30*a* covered by the common cover Sk. The connecting portion 40 is defined by a portion of the cover Sk between the cushion bodies 20*a*, 30*a*. The filling hole Ho for filling the cushion bodies 20*a*, 30*a* is formed in the portion of the cover Sk avoiding the connecting portion 40.

In general, vicinities of the filling hole Ho are folded back on themselves and sewn together. In addition, the hook-and-loop fastener sections 61, 62 are sewn to these vicinities to close the hole Ho and/or the vicinities are defined by a layered portion of the cover Sk to make the inside difficult to view. For this reason, generally, the vicinities of the filling hole Ho are so hard to be difficult to flex. The connecting portion 40 interconnects the first cushion portion 20 and the second cushion portion 30 such that the first cushion portion 20 and the second cushion portion 30 can be brought to the open position to unfold the cushion. In order that the first cushion portion 20 and/or the second cushion portion 30 swings in unfolding and folding the cushion, the connection portion 40 desirably has a high flexibility. Since the filling hole Ho which is so hard to be difficult to flex is formed in the portion avoiding the connecting portion 40, the high flexibility of the connecting portion 40 is ensured. A high operability of the cushion 10 is ensured.

The second cushion portion 30 has the third surface 35 extending generally perpendicularly from an end portion of the second surface 33 of the second cushion portion to the end portion of the second surface 32. When the cushion is in the folded mode, the third surface 35 of the second cushion portion is located closer to the widthwise center of the cushion than the second surface 23 of the first cushion. The one hook-and-loop fastener section 51 is sewn to the second surface 23 of the first cushion portion, and the other hook-and-loop fastener section 53 is sewn to the strap member 52 provided on the third surface 35 of the second cushion portion.

When the second hook-and-loop fastener section 53 is locked to the first hook-and-loop fastener 51 with the strap member 52 pulled, the strap member 52 is subjected to a force Fl pulling the strap member 52 toward the third surface 35 of the second cushion portion. Since the third surface 35 of the second cushion portion is located closer to the widthwise center of the cushion than the second surface 23 of the first cushion portion, a component F2 of the pulling force acts to press the second hook-and-loop fastener section 53 against the first hook-and-loop fastener section 51. As a result, the first and second hook-and-loop fastener sections 51, 53 can be reliably locked to each other when the cushion is in the folded position.

A second embodiment of the present invention is discussed below.

Figure 10:
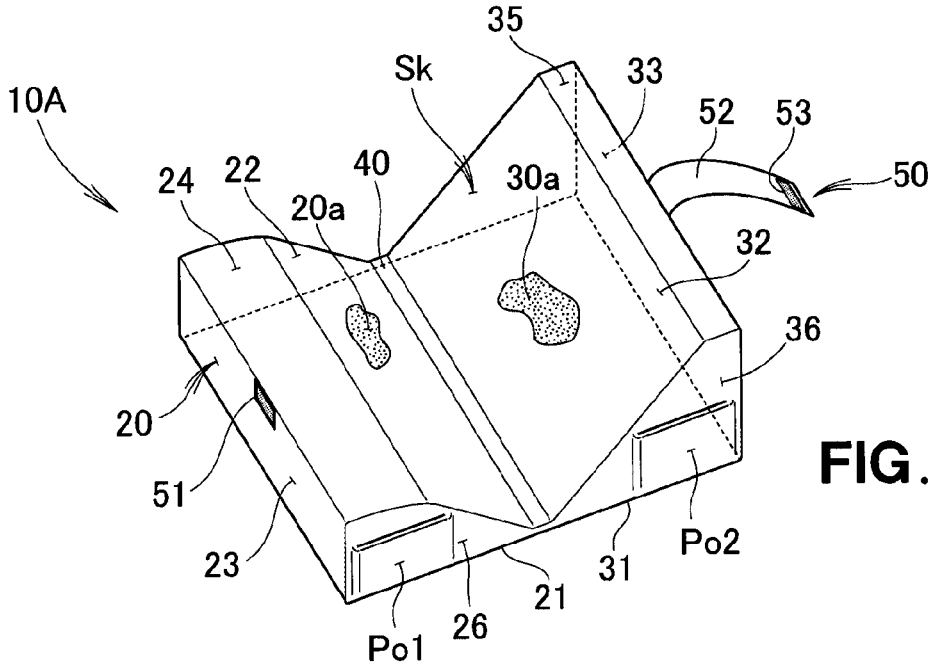
FIG. 10 is a perspective view of a cushion in a second embodiment of the present invention.

FIG. 10 shows a cushion 10A in the second embodiment. The following discussion is made only as to elements of the cushion 10A which differ from those of the cushion 10 (FIG. 1) of the first embodiment, a discussion of the same elements of the cushion 10A as those of the cushion 10 is omitted.

The first and second cushion portions 20, 30 are made up of the cushion bodies 20*a*, 30*a* covered by the cover Sk, respectively, and the cover Sk has pockets Po1, Po2 provided therein. The one pocket Po1 is formed in the lateral side surface 26 of the first cushion portion, and the other pocket Po2 is formed in the lateral side surface 36 of the second cushion portion. Even in this case, the predetermined advantages of the present invention can be achieved.

The cushion 10A in the second embodiment is more convenient because small articles etc. can be put in the pockets Po1, Po2.

A third embodiment of the present invention is discussed below.

Figure 11:
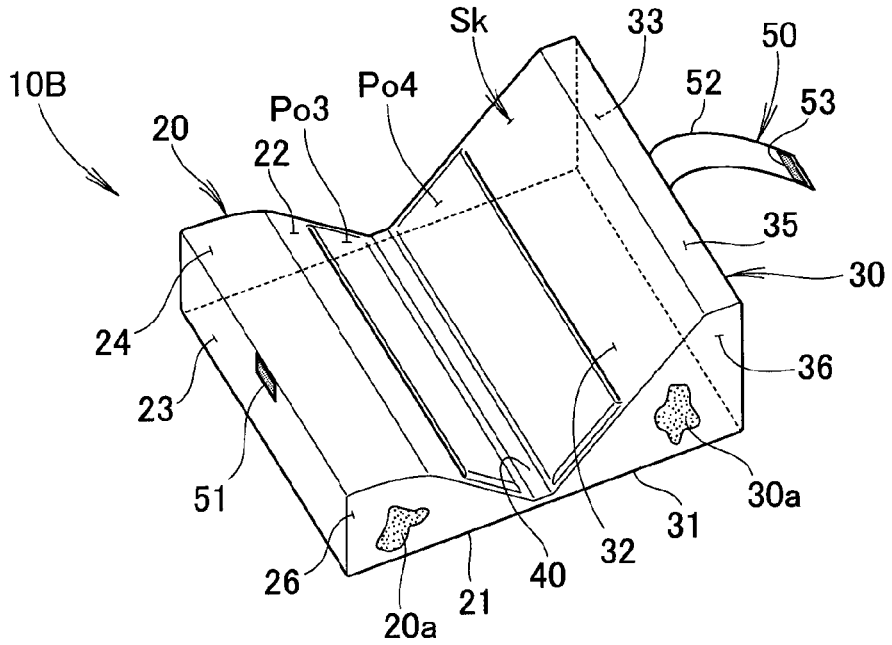
FIG. 11 is a perspective view of a cushion in a third embodiment of the present invention.

FIG. 11 shows a cushion 10B in the third embodiment. The following discussion is made only as to elements of the cushion 10B which differ from those of the cushion 10 (FIG. 1) of the first embodiment, a discussion of the same elements of the cushion 10B as those of the cushion 10 is omitted.

The first and second cushion portions 20, 30 are made up of the cushion bodies 20*a*, 30*a* covered by the cover Sk, respectively, and the cover Sk has pockets Po3, Po4 provided therein. The one pocket Po3 is formed in the inclining surface 22 of the first cushion portion, and the other pocket Po4 is formed in the inclining surface 32 of the second cushion portion. Even in this case, the predetermined advantages of the present invention can be achieved.

The cushion 10B in the third embodiment is more convenient because small articles etc. can be put in the pockets Po3, Po4. When the cushion 10B is used as a foot rest cushion, the following advantages can be achieved.

When the cushion is in the first unfolded mode, the pockets Po3, Po4 are provided in the inclining surfaces 22 and/or 32, and the user's feet rest on the inclining surface 22 and/or the inclining surface 32. Disposable body warmers can be put in the pockets Po3, Po4 to warm the feet, which is more convenient.

A fourth embodiment of the present invention is discussed below.

Figure 12:
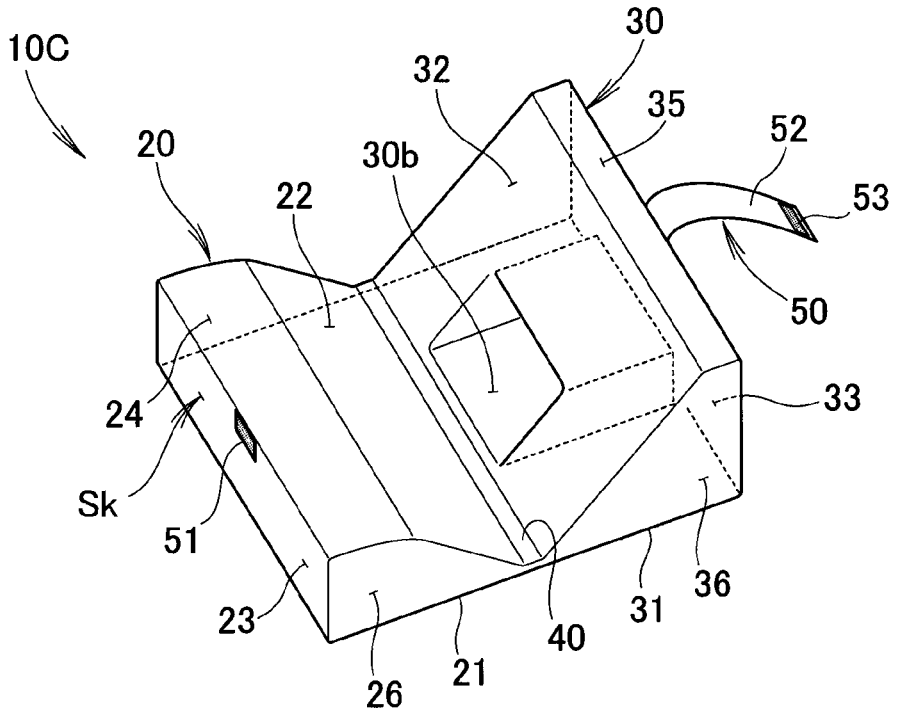
FIG. 12 is a perspective view of a cushion in a fourth embodiment of the present invention.

FIG. 12 shows a cushion 10C in the fourth embodiment. The following discussion is made only as to elements of the cushion 10C which differ from those of the cushion 10 (FIG. 1) of the first embodiment, a discussion of the same elements of the cushion 10C as those of the cushion 10 is omitted.

The second cushion portion 30 has a through-hole 30*b* extending through the inclining surface 32 of the second cushion portion and the second surface 33 of the second cushion portion. The shoes or slippers of the user can be inserted into the through hole 30*b*. Even in this case, the predetermined advantages of the present invention can be achieved.

Although the cushion has been discussed as being used within a vehicle occupant compartment in the foregoing embodiments, the cushion may be used in other locations. That is, the use of the cushion is not limited to the use in the vehicle occupant compartment.

It is appreciated that the present invention is not limited to the embodiments, including the advantages.

The cushion of the present invention is suitable for use in a small location such as a vehicle occupant compartment.

Obviously, various minor changes and modifications of the present invention are possible in light of the above teaching. It is therefore to be understood that within the scope of the appended claims the invention may be practiced otherwise than as specifically described.

What is claimed is:

1. A cushion comprising:

a first cushion portion;

a second cushion portion; and a connecting portion interconnecting the first cushion portion and the second cushion portion such that the first cushion portion and the second cushion portion are brought to an open position to unfold the cushion, the first cushion portion and the second cushion portion being movable to a closed position to fold the cushion along the connecting portion into a generally rectangular parallelepiped, wherein the first cushion portion comprises:

a first surface defining one side of the generally rectangular parallelepiped;

an inclining surface extending obliquely from one end of the first surface; and a second surface extending at a generally right angle from an opposite end of the first surface, wherein the second cushion portion comprises:

a first surface defining another side of the generally rectangular parallelepiped different from the one side;

an inclining surface extending obliquely from one end of the first surface of the second cushion portion; and a second surface extending at a generally right angle from an opposite end of the first surface of the second cushion portion, wherein the connecting portion is provided along one corner of the generally rectangular parallelepiped and interconnects the one end of the first surface of the first cushion portion and the one end of the first surface of the second cushion portion in a state where the cushion is folded into the generally rectangular parallelepiped, wherein the inclining surface of the first cushion portion and the inclining surface of the second cushion portion are both planar surfaces, wherein in a state where the cushion is folded into the generally rectangular parallelepiped, a curved surface of the first cushion is continuous with the inclining surface of the first cushion portion at an end of the inclining surface opposite from the connecting portion, and is away from the inclining surface of the second cushion portion, wherein the cushion has three modes, the three modes being a folded mode, a first unfolded mode, and a second unfolded mode, the folded mode being a mode in which the cushion is folded into the generally rectangular parallelepiped with the inclining surface of the first cushion portion and the inclining surface of the second cushion portion contacting each other to form a gap between the curved surface of the first cushion portion and the inclining surface of the second cushion portion, the first unfolded mode being a mode in which the first surface of the first cushion portion and the first surface of the second cushion portion are both in contact with a ground surface, and the inclining surface of the first cushion portion and the inclining surface of the second cushion portion are opposed to each other, and the second unfolded mode being a mode in which the inclining surface of the first cushion portion and the inclining surface of the second cushion portion are both in contact with the ground surface, and the first surface of the first cushion portion and the first surface of the second cushion portion are opposed to each other, wherein, in the first unfolded mode, a height of the second surface of the second cushion portion is greater than a height of the second surface of the first cushion portion, so that inclining surfaces having different heights are formed to be opposed to each other, and wherein, in the second unfolded mode, both the first surface of the first cushion portion and the second surface of the second cushion portion are formed to be opposed to a user.

2. The cushion of claim 1, wherein in the folded mode, the first cushion portion and the second cushion portion are locked to each other by a hook-and-loop fastener.

3. The cushion of claim 1, wherein the first cushion portion and the second cushion portion both comprise cushion bodies covered by a cover, and the cover has a pocket formed therein.

4. The cushion of claim 2, wherein the first cushion portion and the second cushion portion both comprise cushion bodies covered by a cover, and the cover has a pocket formed therein.

* * * * *